US007593680B2

(12) United States Patent
Shinshi

(10) Patent No.: US 7,593,680 B2
(45) Date of Patent: Sep. 22, 2009

(54) IMAGE FORMING APPARATUS INCLUDING A FIXING APPARATUS CAPABLE OF EFFECTIVELY MAINTAINING FIXABILITY FOR AN EXTENDED PERIOD OF USE

(75) Inventor: Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 134 days.

(21) Appl. No.: 11/669,699

(22) Filed: Jan. 31, 2007

(65) Prior Publication Data

US 2007/0166085 A1 Jul. 19, 2007

(30) Foreign Application Priority Data

Jan. 31, 2006 (JP) ..... 2006-023491

(51) Int. Cl.
*G03G 15/20* (2006.01)

(52) U.S. Cl. ..... 399/329; 219/216; 399/328; 399/333

(58) Field of Classification Search ..... 399/333, 399/328, 329, 330; 219/216, 469; 118/60; 347/156; 492/46, 49, 53, 56
See application file for complete search history.

(56) References Cited

U.S. PATENT DOCUMENTS

| | | | | |
|---|---|---|---|---|
| 5,659,869 | A * | 8/1997 | Ohtsuka et al. | 399/333 |
| 5,716,700 | A * | 2/1998 | Kikukawa et al. | 118/60 X |
| 5,860,051 | A * | 1/1999 | Goto et al. | 399/329 |
| 6,002,106 | A * | 12/1999 | Kataoka et al. | 219/216 |
| 6,882,820 | B2 | 4/2005 | Shinshi et al. | 399/328 |
| 7,014,899 | B2 * | 3/2006 | Chen et al. | 399/333 X |
| 7,127,204 | B2 | 10/2006 | Satoh et al. | 399/329 |
| 7,299,003 | B2 * | 11/2007 | Kurotaka et al. | 399/329 |
| 2002/0018676 | A1 * | 2/2002 | Hirai et al. | 399/329 |
| 2005/0129432 | A1 | 6/2005 | Sato et al. | 399/329 |
| 2005/0207806 | A1 * | 9/2005 | Yoshii et al. | 399/333 |
| 2005/0277048 | A1 | 12/2005 | Tomita | 430/110.3 |
| 2006/0002737 | A1 | 1/2006 | Shinshi | 399/122 |

(Continued)

FOREIGN PATENT DOCUMENTS

CN 1707371 A 12/2005

(Continued)

OTHER PUBLICATIONS

"Sponge Rubber," World Rubber Industry, Period 6, vol. 32, pp. 46-50 and 62, Jun. 20, 2005. (With Partial English Translation).

*Primary Examiner*—Sophia S Chen
(74) *Attorney, Agent, or Firm*—Oblon, Spivak, McClelland, Maier & Neustadt, P.C.

(57) ABSTRACT

An image forming apparatus includes a toner image forming mechanism that forms a toner image on a recording medium and a fixing mechanism that fixes the toner image on the recording medium. The fixing mechanism includes a fixing apparatus. The fixing apparatus includes: an elastic roller having a stiffness greater than or equal to 28 Hs and less than or equal to 34 Hs on an Asker C scale and including a sponge-like elastic layer having a density greater than or equal to 0.38 g/cm$^3$; a high-stiffness roller having a stiffness greater than the stiffness of the elastic roller and forms a fixing nip between the elastic roller and the high-stiffness roller; and a heating mechanism that heats the fixing nip.

19 Claims, 8 Drawing Sheets

U.S. PATENT DOCUMENTS

| | | | | |
|---|---|---|---|---|
| 2006/0116230 | A1 | 6/2006 | Satoh et al. | 474/166 |
| 2006/0165429 | A1 | 7/2006 | Satoh et al. | 399/69 |
| 2007/0003334 | A1 | 1/2007 | Shinshi et al. | 399/327 |
| 2008/0175633 | A1 | 7/2008 | Shinshi | |

FOREIGN PATENT DOCUMENTS

| | | | | |
|---|---|---|---|---|
| JP | 03-017677 | | | 1/1991 |
| JP | 10-307501 | | | 11/1998 |
| JP | 2002-023541 | A | * | 1/2002 |
| JP | 2002-214957 | | | 7/2002 |
| JP | 2004-070159 | | | 3/2004 |
| JP | 2005-043745 | A | * | 2/2005 |
| JP | 2005-049455 | | | 2/2005 |
| JP | 2005-292218 | | | 10/2005 |

* cited by examiner

IMAGE FORMING APPARATUS INCLUDING A FIXING APPARATUS CAPABLE OF EFFECTIVELY MAINTAINING FIXABILITY FOR AN EXTENDED PERIOD OF USE

CROSS REFERENCE TO RELATED APPLICATIONS

This patent application is based on and claims priority under 35 U.S.C. §119 from Japanese patent application No. JP2006-023491, filed on Jan. 31, 2006, in the Japan Patent Office, the entire contents of which are incorporated herein by reference.

BACKGROUND OF THE INVENTION

1. Field of Invention

Exemplary aspects of the present invention generally relate to a fixing unit and an image forming apparatus using the same, and more particularly, it relates to an image forming apparatus including a fixing apparatus capable of effectively maintaining fixability for an extended period of use.

2. Discussion of the Background

In related art toner image forming mechanisms of image forming apparatuses using an electrophotographic method, for example, an electrostatic latent image is formed on a front surface of a photoreceptor serving as an image carrier, and the electrostatic latent image on the photoreceptor is developed and visualized using a developer such as toner. Then, the developed image is transferred onto a recording medium by a transfer apparatus. The recording medium carrying an unfixed image is fixed by a fixing apparatus using pressure, heat, and so forth, so that the toner image is fixed on the recording medium. The recording medium on which the toner image is fixed is ejected outside the image forming apparatus. The fixing apparatus is provided with two rotary fixing members composed of rollers facing one another, or belts, or a combination of a roller and a belt. The two rotary fixing members nip the recording medium therebetween and apply heat and pressure so as to fix the toner image on the recording medium.

At a place where the two rotary fixing members nip the recording medium, two rollers are disposed facing each other through a belt, when a belt is provided. The two rollers push each other in such a manner that one of the elastic rollers having a relatively low stiffness among the two rollers is recessed compared with the other roller having a relatively high stiffness. Thereby, the fixing nip is formed. In addition, when the belt is provided, the two rollers push each other through the belt therebetween so as to form the fixing nip.

In recent years, along with a tendency to downsize an image forming apparatus, it is necessary to downsize the two rollers which form the fixing nip in order to achieve downsizing of the fixing apparatus. If a diameter of the rollers is reduced, a deformation amount at the fixing nip is reduced even if the stiffness of the elastic rollers is the same. If a width of the fixing nip is reduced, this might cause a reduction of fixability. As a fixing apparatus that secures the width of the fixing nip in spite of downsizing of the two rollers, there is a fixing apparatus using elastic rollers with low stiffness having a sponge-like elastic layer. According to Japanese Patent Laid-Open Application Publication No. 2005-49455 and Japanese Patent Application Publication No. 3506880, an elastic roller using a roller with low stiffness having a sponge-like elastic layer is proposed. In Japanese Patent Laid-Open Application Publication No. 2005-49455, an elastic roller having the stiffness of greater than or equal to 5 Hs and less than or equal to 40 Hs on the Asker C scale is proposed. In Japanese Patent Application Publication No. 3506880, an elastic roller having the stiffness of greater than or equal to 10 Hs and less than or equal to 50 Hs on the Asker C scale is proposed. When using the elastic roller with low stiffness, the width of the fixing nip is secured, and the fixability is maintained even if the two rollers are downsized.

However, in the related arts, when the elastic roller with the low stiffness having the sponge-like elastic layer is used for a long period of time, the width of the fixing nip may be reduced. The possible reason for the reduction of the width of the fixing nip may be considered as follows.

In the elastic layer, many holes or cells separated by walls are formed so as to create the sponge-like layer. In the case where the cells are compressed and collapsed, the surface elastic force is obtained due to the resilience of the walls forming the cells, thereby being able to obtain a desired nip pressure. If the pressure is repeatedly applied to the sponge-like elastic layer, the walls forming the cells may be damaged or destroyed. At a place where the cells are destroyed, the surface resilience of the walls is decreased. Furthermore, as destruction of the cells progresses, the surface elastic force of the elastic roller is decreased. The stiffness on the Asker C scale is also decreased.

Changes to the fixing nip as the destruction of the cells in the elastic layer of the elastic roller progresses are explained with reference to FIG. 1A and FIG. 1B. FIG. 1A is an enlarged view of an area in the vicinity of the fixing nip before the destruction of the cells occurs. FIG. 1B is an enlarged view of an area in the vicinity of the fixing nip after the destruction of the cells takes place. As shown in FIG. 1A, an elastic roller 51 and a high-stiffness roller 52 push each other so that the shape of the elastic roller 51 is changed by large amount. Thereby, a fixing nip is formed. A surface moving direction of the elastic roller 51 and the high-stiffness roller 52 in the fixing nip is shown by an arrow A in FIGS. 1A and 1B. With the decrease in the surface elastic force of the elastic roller 51, the elastic layer portion of the elastic roller 51 forming a nip entrance B and a nip exit C is gradually separated from the high-stiffness roller 52. Therefore, it is assumed that the width W of the fixing nip is decreased, as shown in FIG. 1B.

When the width W of the fixing nip is decreased, it may not be able to adequately apply heat and pressure to a toner image on the recording medium passing the fixing nip. Therefore, there may be a problem in which the fixability of the toner image relative to the recording medium is deteriorated.

SUMMARY OF THE INVENTION

In view of the foregoing, exemplary embodiments of the present invention provide an image forming apparatus including a toner image forming mechanism configured to form a toner image on a recording medium and a fixing mechanism configured to fix the toner image on the recording medium.

At least one exemplary embodiment of the present invention provides a fixing mechanism including a fixing apparatus. The fixing apparatus includes: an elastic roller having a stiffness greater than or equal to 28 Hs and less than or equal to 34 Hs on the Asker C scale and including a sponge-like elastic layer having a density greater than or equal to 0.38 g/cm$^3$; a high-stiffness roller having a stiffness greater than the stiffness of the elastic roller and configured to form a fixing nip between the elastic roller and the high-stiffness roller; and a heating mechanism configured to heat the fixing nip.

In one exemplary embodiment of the above mentioned image forming apparatus, a material for the elastic layer of the elastic roller includes a rubber.

In one exemplary embodiment of the above mentioned image forming apparatus, the fixing apparatus further comprises: a plurality of spanning members, with one spanning member being the elastic roller and a fixing belt having a belt shape supported by the plurality of spanning members and heated by the heating mechanism. The high-stiffness roller presses the elastic roller through the fixing belt so as to form the fixing nip therebetween.

In one exemplary embodiment of the above mentioned image forming apparatus, the elastic roller serves as a fixing roller facing, in the fixing nip, a surface carrying a not-fixed image on the recording medium. The high-stiffness roller serves as a pressing roller configured to press, in the fixing nip, the rear surface of the surface that carries the not-fixed image on the recording medium.

In one exemplary embodiment of the above mentioned image forming apparatus, the fixing apparatus satisfies a relationship expressed by Ak>At+20 Hs, where a stiffness of the elastic roller on Asker C scale is At, and a stiffness of the high-stiffness roller on Asker C scale is Ak.

In one exemplary embodiment of the above mentioned image forming apparatus, the fixing apparatus satisfies a relationship expressed by $Stmin/St \geqq 0.75$, where a thickness of the elastic layer in a state where the fixing nip is not formed is St, and a minimum thickness of the elastic layer in a state where the fixing nip is formed is Stmin.

In one exemplary embodiment of the above mentioned image forming apparatus, the elastic roller includes the elastic layer and a metal shaft made of metal.

In one exemplary embodiment of the above mentioned image forming apparatus, the fixing apparatus satisfies a relationship expressed by $St/Rs \leqq 1.5$, where a radius of the metal shaft is Rs, and the thickness of the elastic layer is St.

In one exemplary embodiment of the above mentioned image forming apparatus, the fixing apparatus satisfies a relationship expressed by $1.2 \leqq St/Rs \leqq 1.5$, where the radius of the metal shaft is Rs, and the thickness of the elastic layer is St.

At least one exemplary embodiment of the present invention provides an image forming apparatus including a toner image forming mechanism configured to form an toner image on a recording medium, and the fixing mechanism configured to fix the toner image on the recording medium and including a fixing apparatus.

In one exemplary embodiment of the above mentioned image forming apparatus, the fixing apparatus includes: an elastic roller including a sponge-like elastic layer and a metal shaft comprising metal; a high-stiffness roller with a stiffness greater than a stiffness of the elastic roller, and configured to form a fixing nip between the elastic roller and the high-stiffness roller; and a heating mechanism configured to heat the fixing nip. The stiffness of the elastic roller is greater than or equal to 28 Hs and less than or equal to 34 Hs on an Asker C scale. The density of the elastic layer differs in a radial direction of the elastic roller, and the density of the elastic layer is greater toward the metal shaft.

In one exemplary embodiment of the above mentioned image forming apparatus, the elastic layer has a unitary structure, and a size of cells is smaller towards an inner side or the metal shaft side, and is greater toward the outside.

In one exemplary embodiment of the above mentioned image forming apparatus, a material for the elastic layer includes a rubber.

In one exemplary embodiment of the above mentioned image forming apparatus, the fixing apparatus further comprises: a plurality of spanning members with one spanning member being the elastic roller, and a fixing belt having a belt shape supported by a plurality of spanning members, and heated by the heating mechanism. The high-stiffness roller presses the elastic roller through the fixing belt so as to form the fixing nip therebetween.

In one exemplary embodiment of the above mentioned image forming apparatus, the elastic roller of the fixing apparatus is a fixing roller facing, in the fixing nip, a surface carrying a not-fixed image on the recording medium. The high-stiffness roller is a pressing roller configured to press in the fixing nip a rear side of the surface carrying the not-fixed image on the recording medium.

In one exemplary embodiment of the above mentioned image forming apparatus, the fixing apparatus satisfies a relationship expressed by Ak>At+20 Hs, where a stiffness of the elastic roller on the Asker C scale is At, and a stiffness of the high-stiffness roller on the Asker C scale is Ak.

At least one exemplary embodiment of the present invention provides a fixing mechanism configured to fix the toner image on the recording medium and including a fixing apparatus.

In one exemplary embodiment of the above mentioned fixing apparatus, there is provided: an elastic roller having a stiffness greater than or equal to 28 Hs and less than or equal to 34 Hs on an Asker C scale and including a sponge-like elastic layer having a density greater than or equal to 0.38 $g/cm^3$; a high-stiffness roller having a stiffness greater than a stiffness of the elastic roller, and configured to form a fixing nip between the elastic roller and the high-stiffness roller; and a heating mechanism configured to heat the fixing nip.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1A:
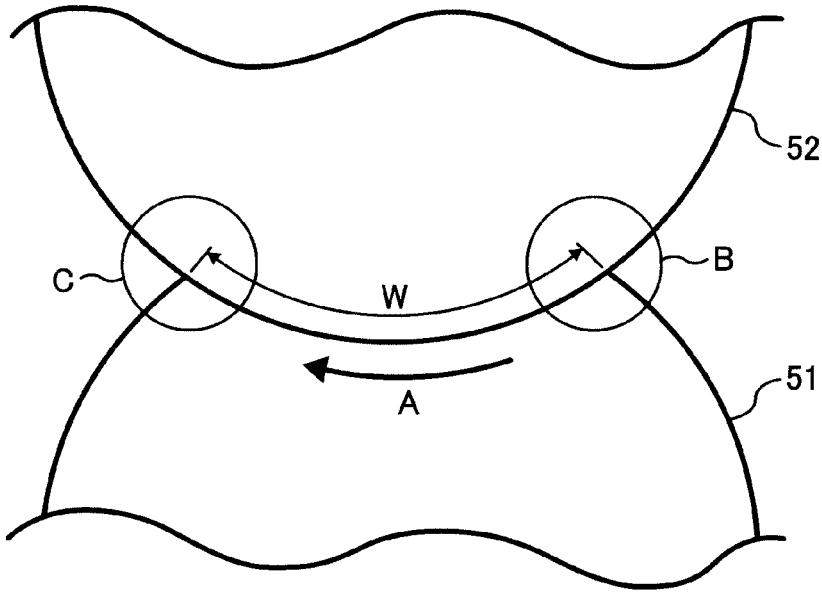
FIG. 1A is an enlarged view illustrating an area adjacent to a fixing nip before cell destruction takes place.
Figure 1B:
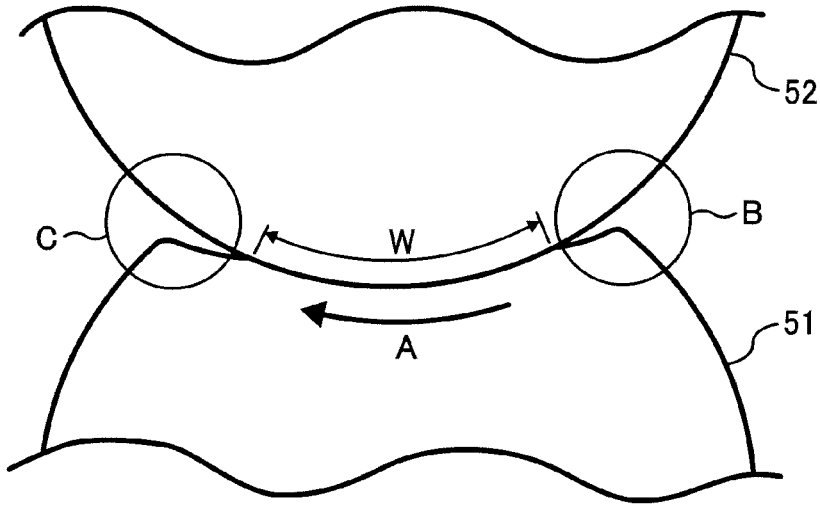
FIG. 1B is an enlarged view illustrating the area adjacent to the fixing nip after the cell destruction progresses.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are given to materials and constituent parts having the same functions, and descriptions thereof will be omitted unless otherwise stated. Exemplary embodiments of the present invention are now explained below with reference to the accompanying drawings. In the later described comparative examples, exemplary embodiments, and alternative examples, the same reference numerals will be given to constituent elements such as parts and materials having the same functions, and the descriptions thereof will be omitted. Referring now to the drawings, wherein like reference numerals designate identical or corresponding parts throughout the several views, particularly to FIG. 2, a structure of a color laser printer according to an exemplary embodiment of the present invention is described.

Figure 2:
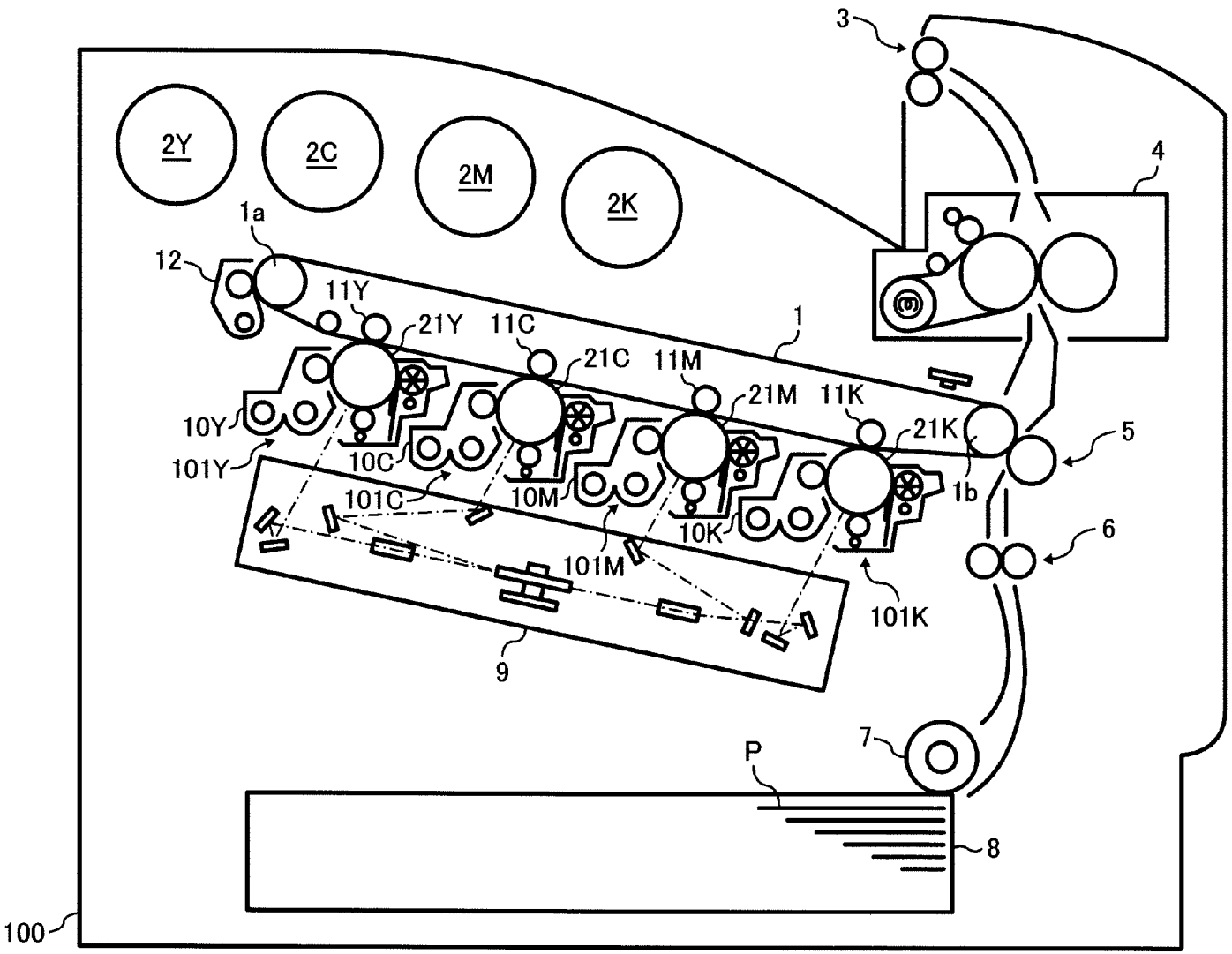
FIG. 2 is a schematic diagram illustrating a color laser printer according to a first exemplary embodiment of the present invention.

Exemplary embodiments of the present invention will be explained below with reference to drawings. A description will now be given of one exemplary embodiment of the present invention which may be applied to a color laser printer as an image forming apparatus (hereinafter referred to as a printer 100). FIG. 2 is a schematic diagram illustrating the printer 100 of the first exemplary embodiment. The printer 100 includes a tandem image forming unit in which four toner image forming mechanisms of four different colors yellow (Y), cyan (C), magenta (M) and black (K) are horizontally arranged. In the tandem image forming unit, toner image forming units 101Y, 101C, 101M and 101K, each serving as a toner image forming mechanism for the respective designated color are sequentially arranged from the left in FIG. 2. Letters Y, C, M and K refer to the designated colors of yellow, cyan, magenta and black, respectively. In the tandem image forming unit, each of the toner image forming units 101Y, 101C, 101M and 101K includes the respective drum-type photoreceptor 21Y, 21C, 21M and 21K around which are arranged charging devices, developing apparatuses 10Y, 10C, 10M and 10K, photoreceptor cleaning apparatuses, and so forth. At a top portion of the printer 100, toner bottles 2Y, 2C, 2M and 2K, in which toners of respective colors of yellow, cyan, magenta and black are filled, are disposed. A predetermined amount of toner of each color is supplied from the toner bottles 2Y, 2C, 2M and 2K to each of the respective developing apparatuses 10Y, 10C, 10M and 10K through not-shown conveyance paths.

An optical writing unit 9 serving as a latent image forming mechanism is provided at a bottom portion of the tandem image forming apparatus. The optical writing unit 9 includes a light source, a polygon mirror, f-θ lenses, reflecting mirrors and so forth. The optical writing unit 9 is structured such that the optical writing unit scans a laser beam, and irradiates the scanned laser beam onto a surface of each photoreceptor 21 based on image data.

Immediately above the tandem image forming unit, an endless-belt type intermediate transfer belt 1 serving as an intermediate transfer body is disposed. The intermediate transfer belt 1 is spanned between supporting rollers 1*a* and 1*b*. A drive motor (not-shown) as a drive source is connected to a rotary shaft of the supporting roller 1*a* which is a drive roller. When the drive motor is driven, the intermediate transfer belt 1 is rotatively moved in a counterclockwise direction, thereby causing the supporting roller 1*b* to rotate. On an inner side of the intermediate transfer belt 1, there are provided primary transfer apparatuses 11Y, 11C, 11M and 11K which transfer a toner image formed on the photoreceptors 21Y, 21C, 21M and 21K onto the intermediate transfer belt 1.

Downstream from the primary transfer apparatuses 11Y, 11C, 11M and 11K in the driving direction of the intermediate transfer belt 1, a secondary transfer roller 5 serving as a secondary transfer apparatus is provided. The supporting roller 1*b* is disposed across from the secondary transfer roller 5 with the intermediate transfer belt 1 therebetween. The supporting roller 1*b* serves as a pressing member. Also provided is a sheet feed cassette 8 which stores transfer paper P as a recording medium, a sheet feed roller 7, registration rollers 6 and so forth. Furthermore, downstream from the secondary transfer roller 5 in the moving direction of the transfer paper P on which the toner image is transferred by the secondary transfer roller 5, there are provided a fixing apparatus 4 which fixes the image on the transfer paper P, and sheet eject rollers 3.

Figure 3:
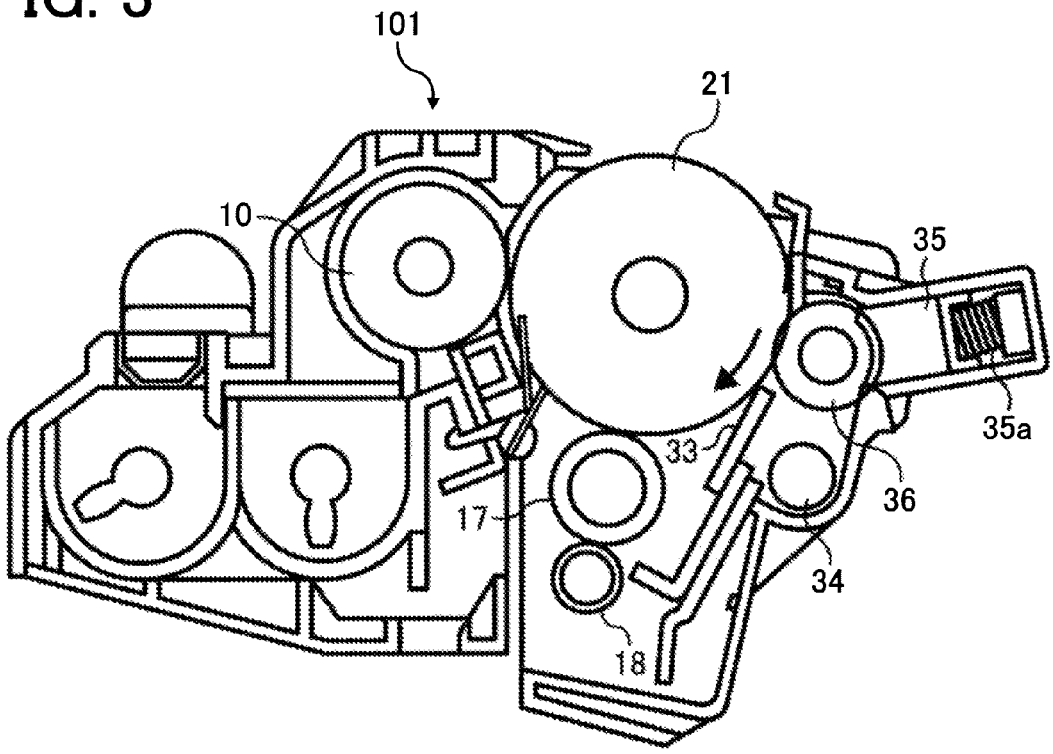
FIG. 3 is a schematic diagram illustrating a process cartridge which constitutes a toner image forming portion of the printer of FIG. 2.

Next, a description will be given of an operation of the printer 100. The toner image forming units 101Y, 101C, 101M and 101K rotate the respective photoreceptors 21Y, 21C, 21M and 21K. Along with the rotation of the photoreceptors 21Y, 21C, 21M and 21K, the surfaces of the photoreceptors 21Y, 21C, 21M and 21K are evenly charged by charging devices (FIG. 3 shows a charging roller 17 as an exemplary charging device that can evenly charge the photoreceptors 21Y, 21C, 21M and 21K), respectively. Subsequently, the optical writing unit 9 emits the laser beam of the image data onto the photoreceptors 21Y, 21C, 21M and 21K so as to form an electrostatic latent image thereon. Then, toner is adhered by the developing apparatuses 10Y, 10C, 10M and 10K so that the electrostatic latent image is visualized. Accordingly, monochromatic images of yellow, cyan, magenta and black are formed on the respective photoreceptors 21Y, 21C, 21M and 21K. The drive motor (not shown) rotatively drives the drive roller or supporting roller 1*a*, causing the driven roller lb and the secondary transfer roller 5 to rotate. The intermediate transfer belt 1 is rotatively driven so that the visual images are sequentially transferred onto the intermediate transfer belt 1 by the primary transfer apparatuses 11Y, 11C, 11M and 11K. Accordingly, a color composite image is formed on the intermediate transfer belt 1. After the image is transferred, a photoreceptor cleaning apparatus removes the residual toner from the surfaces of the photoreceptors 21Y, 21C, 21M and 21K and cleans the surfaces thereof so as to prepare for the subsequent image forming processing.

Corresponding to the timing of image formation, the transfer paper P is transferred from the paper feed cassette 8 by the sheet feed roller 7. The transfer paper P is transferred to the registration rollers 6 and is temporarily stopped. While corresponding to the timing of the image forming operation, the transfer paper P is transferred to a place between the secondary transfer roller 5 and the intermediate transfer belt 1. The intermediate transfer belt 1 and the secondary transfer roller 5 nip the transfer paper P forming a so-called secondary transfer nip. The secondary transfer roller 5 secondarily transfers the toner image on the intermediate transfer belt 1 to a recording medium.

The transfer paper P on which the image is transferred is sent to the fixing apparatus 4. The fixing apparatus 4 applies heat and pressure on the transfer paper P so as to fix the transfer image thereon. Then, the transfer paper P is ejected outside the printer. In the meantime, the residual toner remained on the intermediate transfer belt 1 after the image is transferred is removed by a cleaning unit 12 so as to prepare the intermediate transfer belt 1 for another image forming processing in the tandem-type image forming unit.

The toner image forming units 101Y, 101C, 101M and 101K of each color are integrally formed and are formed as a process cartridge attachable to/detachable from the main body. The integrated process cartridges may be pulled out to the front of the printer 100 main body along a guide rail (not shown) fixed to the printer 100 main body. When the process cartridges are pushed toward the back of the printer 100 main body, the toner image forming units 101Y, 101C, 101M and 101K may be installed at a predetermined position.

The process cartridges of each of the toner image forming units 101Y, 101C, 101M and 101K have the same structure and perform the same operation. Therefore, letters Y, C, M and K indicating colors are omitted. A detailed description will be given of the process cartridges of the toner image forming units 101Y, 101C, 101M and 101K, respectively. FIG. 3 is an exploded view of one of the process cartridges of a toner image forming unit 101 with the letter indicating color omitted. The toner image forming unit 101 can be any of the toner image forming units 101Y, 101C, 101M and 101K.

In FIG. 3, surrounding the photoreceptor 21 in a clockwise direction, sequentially provided are: a charging roller 17 serving as a charging apparatus, the developing apparatus 10, a fur brush 36 serving as a photoreceptor cleaning apparatus, a cleaning blade 33 and so forth. In such a manner, in the printer 100, the charging roller 17 is disposed at a position vertically downward from the photoreceptor 21. Downward from the charging roller 17 there is provided a cleaning roller 18 serving as a charged cleaning roller which rotatively comes into contact with the surface of the charging roller 17 so as to clean the surface thereof. The rotating motion of the charging roller 17 causes the cleaning roller 18 to rotate. The photoreceptor cleaning apparatus includes the fur brush 36, the cleaning blade 33, and a waste toner conveyance coil 34 which ejects waste toner brushed off from the photoreceptor 21, outside the process cartridge. A reference numeral 35 herein refers to a lubricant agent, and 35*a* refers to a biasing mechanism, for example, a spring.

Figure 4:
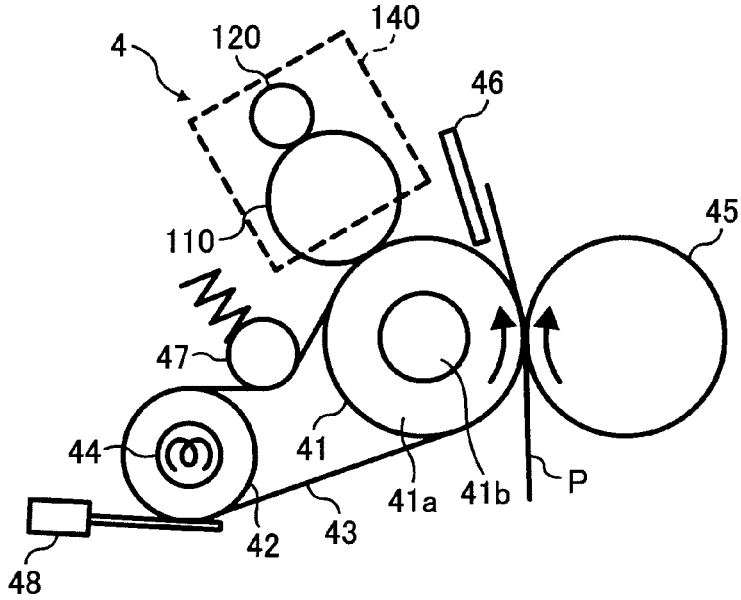
FIG. 4 is a schematic diagram illustrating a fixing apparatus.

FIG. 4 is a schematic diagram illustrating the fixing apparatus 4. The fixing apparatus 4 includes: a fixing roller 41 which is an elastic roller having a sponge-like elastic layer; and a pressing roller 45 which is a high-stiffness roller having a stiffness greater than that of the fixing roller 41 and disposed in such a manner facing the fixing roller 41 having a fixing belt 43 therebetween. As shown in FIG. 4, in the fixing apparatus 4, the endless-type fixing belt 43 is spanned between a plurality of spanning members, that is, between a heating roller 42 and the fixing roller 41. The fixing roller 41 is formed of a rubber layer 41*a* which is an elastic layer made of rubber, and a metal shaft 41*b* made of metal. The heating roller 42 has a metal shaft made of metal in which a heater 44 serving as a heating mechanism such as a halogen lamp is installed. The radiant heat thereof heats the fixing belt 43 from inside. A thermistor 48, which is a temperature sensor element, is disposed at a position opposite to the heating roller 42 via the fixing belt 43. Based on the temperature detected by the thermistor 48, the temperature of the heater 44 is controlled so as to have the configured temperature.

A pressing roller 45 presses the fixing roller 41 through the fixing belt 43. The pressing roller 45 is rotated by a drive mechanism (not shown), thereby causing the fixing roller 41 to rotate. In the fixing apparatus 4, a tension roller 47 is provided such that the tension roller 47 is in contact with the vicinity of a center portion of the fixing belt 43. The tension roller 47 presses the fixing belt 43 inward by means of a spring so that a tension is exerted on the fixing belt 43. In one exemplary embodiment, the drive mechanism is provided to the pressing roller 45. However, the drive mechanism may be provided to the fixing roller 41 to cause the pressing roller 45 to rotate. Downstream from the fixing nip in the sheet conveyance direction is provided a separation claw 46 to prevent the transfer paper P from winding around the fixing belt 43.

In the fixing apparatus 4, a parting agent applicator 140 is provided in order to prevent fused toner from adhering on the fixing belt 43. The parting agent applicator 140 is in contact with the fixing belt 43 pressing against the fixing belt 43, thereby moving together with the fixing belt 43. The parting agent applicator 140 is provided with a parting agent application roller 110 which supplies the parting agent to the fixing belt 43. The parting agent application roller 110 is formed of a permeable material such as a sponge, and stores, for example, a silicone oil as the parting agent. When the fixing belt 43 rotates causing the parting agent application roller 110 to rotate, the parting agent application roller 110 is able to rotate at the same speed as that of the fixing belt 43. Consequently, the parting agent is evenly applied on the fixing belt 43. When the parting agent is evenly applied on the fixing belt 43 in such a manner, a so-called offset, in which the fused toner adheres on the fixing belt 43, may be suppressed.

Furthermore, the parting agent applicator 140 is provided with a cleaning roller 120 which removes paper dust or the like adhered on the parting agent application roller 110 by pressing the parting agent application roller 110. The cleaning roller 120 has a brush-like surface, for example, and is driven to rotate along with the rotation motion of the parting agent application roller 110. The brush may be formed of an electrically conductive material so that the paper dust or the like adhered on the parting agent application roller 110 may be electrostatically removed. In FIG. 4, the parting agent applicator 140 is provided to the fixing belt 43. However, without limiting the above, the parting agent applicator 140 may be provided to the pressing roller 45.

In the fixing apparatus 4, the pressing roller 45 has an elastic layer comprised of a material such as a silicone rubber over the metal shaft of aluminum or iron. The surface layer may be comprised of a parting layer of PFA or PTFE. The fixing belt 43 is formed of a base material such as nickel and polyimide having the parting layer of PFA, PTFE or the like, or has the elastic layer of the silicone rubber therebetween. The fixing belt 43 is spanned between the fixing roller 41 and the heating roller 42, and is pressed by the tension roller 47 from outside so that an appropriate tension is maintained. The fixing roller 41 is formed of the metal shaft 41*b* made of metal and the rubber layer 41*a* made of a silicone rubber. The heating roller 42 is a hollow roller made of aluminum or iron having the heater 44 therein. The heater 44 is not limited to a halogen heater, but may utilize induction heating.

In the method applied to the fixing apparatus 4 using a fixing belt, for example, the fixing roller 41 is made relatively softer than the pressing roller 45 in order to generally enhance the separation of the transfer paper P after fixing. Accordingly, the sheet transfer direction after the transfer paper P has passed the fixing nip becomes the pressing side, that is, the non-imaging surface. Therefore, the transfer paper P is easily separated despite the adhesion of the toner on the imaging surface. Furthermore, the stiffness of the fixing roller 41 is configured be as low as possible so that a wide fixing nip is secured. A fixing roller of high insulation, that is, low thermal conductivity is used for the fixing roller 41 to be in contact with the fixing belt 43 so that heat from the heated fixing belt 43 does not easily transfer to the fixing roller 41. Consequently, the fixing belt 43 is not easily cooled, thereby making it possible to expedite the time required for warm-up. To minimize the warm-up time, a fixing roller 41 having a sponge-like rubber layer, which is comprised of a low thermal conductive material, is used. Furthermore, when a fixing belt 43 with low heat capacity is used, heat is effectively transmitted to the fixing nip. Therefore, it is possible to minimize the warm-up time.

Next, the measurements of an exemplary embodiment are described. The diameter of the fixing roller 41 is 29 mm. The fixing roller 41 with the stiffness in the range of 28 Hs to 34 Hs on the Asker C scale may be used. In the fixing apparatus 4, the fixing roller 41 with the stiffness of 31 Hs on the Asker C scale was used. The diameter of the pressing roller 45 is 30 mm, and the stiffness thereof is 57±3 Hs on the Asker C scale. In the fixing apparatus 4, the pressing roller 45 with the stiffness of 57 Hs on the Asker C scale was used. The width of the fixing nip may be between 8 mm and 9 mm. The position of the pressing roller 45 is configured such that the radiuses of the two rollers are added, and the center distance of the two rollers is subtracted from the combined radiuses of the two rollers so that the depression amount of the fixing roller 41 becomes between 2.2 mm and 2.3 mm. The linear velocity at the fixing nip is greater than or equal to 180 mm/sec to achieve high-speed image formation. In the fixing apparatus 4, the linear velocity was 182 mm/sec.

The transfer paper P advances from below towards the fixing nip constituted by the fixing roller 41 and the pressing roller 45. In the fixing nip, the predetermined heat and pressure are applied so that the image is fixed on the transfer paper P. Subsequently, the transfer paper P is guided by the separation claw 46 so as to be transferred in the upward direction in FIG. 4.

In recent years, due to the demands for downsizing the image forming apparatus, it is desirable to reduce the diameter of the fixing roller 41 and the pressing roller 45. The fixing roller 41 and the pressing roller 45 having the diameter within the range of 20 mm to 40 mm, for example, may be utilized. When the small diameter of the fixing roller 41 and the pressing roller 45 is achieved, the fixing apparatus 4 is downsized, accordingly. Consequently, the heat capacity will become low as a result of downsizing of the fixing apparatus 4. The warm-up time is reduced, and unnecessary radiation is minimized. Therefore, the conservation of energy is achieved.

On the other hand, due to the enhancement of the speed of the image forming apparatus, the width of the fixing nip needs to be wide in order to secure the heat to be applied to toner. In order to downsize the rollers, and yet to obtain a wide width of the fixing nip, the stiffness of one of the rollers needs to be reduced even more. In addition, the rollers need to press each other with a high load. Consequently, the stress to be applied onto the rubber layer increases compared with the related art image forming apparatus. Thus, the cells in the sponge layer which constitutes the fixing roller may easily be destroyed. Furthermore, when the rubber layer 41*a* of the fixing roller 41 is a sponge-like rubber, there is a problem associated with an endurance of the fixing roller 41. The reason is assumed that in a state where the temperature of the rubber layer 41*a* is maintained high, and the mechanical strength of the sponge-like rubber is decreased, the rubber which forms cells in the sponge is deteriorated each time the fixing roller 41 is rotated, that is, the nip portion is repeatedly deformed. Furthermore, in a case where the driving force is applied to either the fixing roller 41 or the pressing roller 45, when one of the rollers starts to rotate or the rotation of one of the rollers stops, the shearing force is applied to the rubber layer 41*a* of the fixing roller 41 due to the stress or the inertial force of the other roller. Thereby, the endurance of the fixing roller 41 is deteriorated.

Figure 5A:
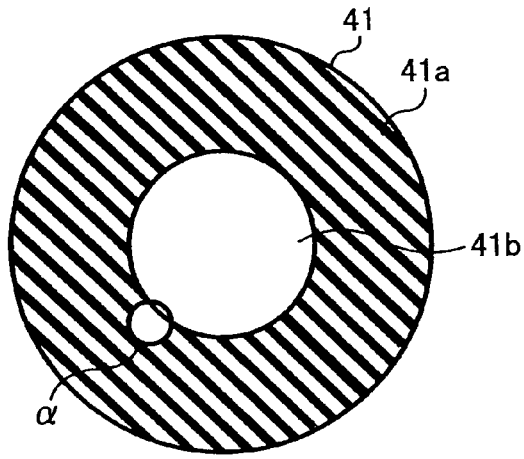
FIG. 5A is a cross-sectional view illustrating a fixing roller.
Figure 5B:
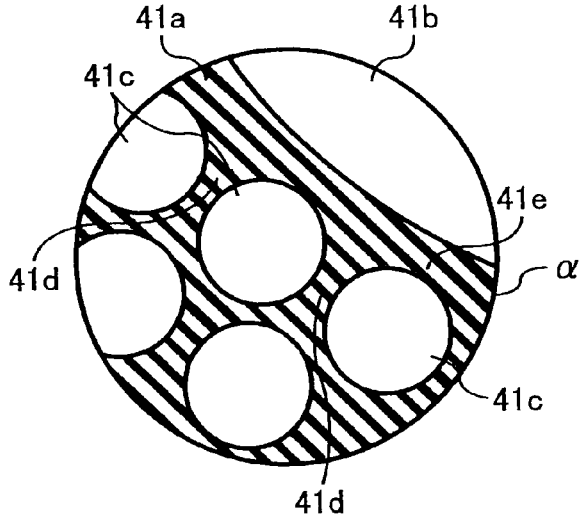
FIG. 5B is an enlarged view illustrating a region α of FIG. 5A.
Figure 5C:
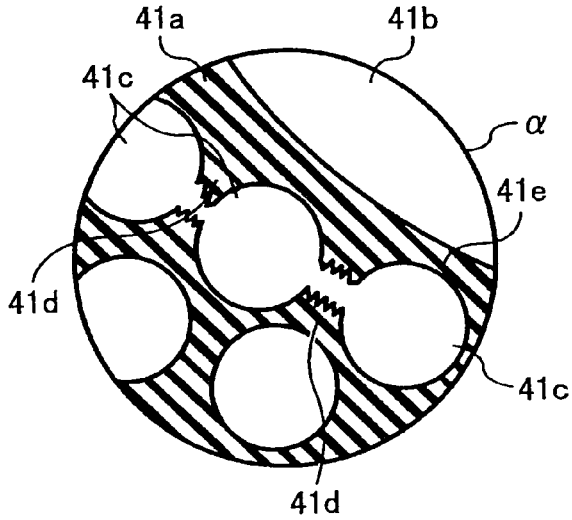
FIG. 5C is an enlarged view illustrating the destruction of cells in the region α.

With reference to FIGS. 5A, 5B and 5C, a description will now be given of how destruction of the cells in the rubber layer 41*a* occurs. FIG. 5A is a cross-sectional view of the fixing roller 41. FIG. 5B is an enlarged view of a region α of FIG. 5A. FIG. 5C illustrates a state in which cells are destroyed in the region α. As shown in FIG. 5A, the rubber layer 41*a*, which is the elastic layer of the fixing roller 41, is sponge like forming a number of cells therein. In the rubber layer 41*a* prior to usage, as shown in FIG. 5B, cells 41*c* are separated by wall portions 41*d*. In the fixing nip, the cells 41*c* are compressed so that the rubber layer 41*a* is in a depressed state. When the resilience of the wall portions 41*d* forming the cells 41*c* is applied, the nip pressure is applied to the fixing nip. Thereby, the shape of the rubber layer 41*a* is restored to its original shape after passing the fixing nip. When the rubber layer 41*a* is depressed at the fixing nip, and its original shape is restored after passing the fixing nip, the stress is repeatedly applied to the rubber layer 41*a* so that the wall portions 41*d* which constitute the cells 41*c* are destroyed. Consequently, a state in which the cells 41*c* adjacent to each other are connected is generated.

At a place where the destruction of the cells 41*c* takes place, the resilience of the wall portions 41*d* is reduced. When more wall portions 41*d* are broken, the elastic force of the surface of the fixing roller 41 is decreased, and the stiffness thereof on the Asker C scale is decreased. The lower the density of the rubber layer 41*a* is, that is, the less the rubber portion constituting the wall portions 41*d* is, the thinner the wall portions 41*d* of each of the cells 41*c* become. Consequently, the wall portions 41*d* of the cells 41*c* are easily broken.

In first experiment, the fixing apparatus 4 having the structure as shown in FIG. 4 was used. An evaluation was performed on the destruction of the cells 41*c* after an image formation was performed on 60,000 sheets using the rubber layer 41*a* of the fixing roller 41. The rubber layers 41*a* with different densities were evaluated. If the fixing nip was less than or equal to a predetermined width of 8 mm, the destruction of the cells 41*c* was determined as "Not-good". The reason is that when the destruction of the cells 41*c* progresses, the elastic force of the surface of the fixing roller 41 is decreased, that is, the stiffness of the roller on the Asker C scale is decreased. Consequently, the pressure of the fixing roller 41 in the fixing nip is decreased so that the width of the fixing nip is reduced.

The conditions of the first experiment are as follows. The experimental conditions of the fixing roller are: The diameter is 29 mm; The diameter of the metal shaft made of iron is 10 mm; The thickness of the rubber layer made of a silicone rubber is 9.5 mm; The stiffness on the Asker C scale is 31 Hs, and the rubber layer densities are 0.37 g/cm$^3$, 0.38 g/cm$^3$, 0.39 g/cm$^3$ and 0.4 g/cm$^3$. The experimental conditions of the pressing roller were: The diameter is 30 mm; The diameter of the metal shaft made of iron is 23 mm; The thickness of the rubber layer made of a silicone rubber is 3.5 mm; The stiffness on the Asker C scale is 57 Hs; The linear velocity of the surface of the pressing roller is 182 mm/sec and the center distance is 26.2 mm. (The pressing force of the pressing roller is 200 N, and the depressed amount is 3.3 mm.) The density of the rubber layer is measured using the following method. The mass and the volume of the metal shaft before molding are measured, and then the roller is molded. Subsequently, the mass and the volume of the roller are measured, and the mass and the volume of the metal shaft are subtracted therefrom so as to calculate the mass and the volume of the rubber layer. The density (the mass divided by the volume) of the rubber layer is calculated. The volume is measured by sinking the metal shaft alone and by sinking the roller after molding. The rubber layer has a simple cylindrical shape when the roller has a roller shape. Accordingly, the volume may geometrically be measured based on an internal diameter, an external shape and the length of the rubber layer.

TABLE 1 shows the result of the first experiment.

TABLE 1

| | | | | |
|---|---|---|---|---|
| RUBBER DENSITY ($g/cm^3$) | 0.37 | 0.38 | 0.39 | 0.4 |
| NIP WIDTH BEFORE USE (mm) | 8.5 | 8.5 | 8.5 | 8.5 |
| NIP WIDTH AFTER 60,000 PRINTS WERE MADE | 7.5 | 8.3 | 8.4 | 8.5 |
| | NOT GOOD | GOOD | GOOD | GOOD |
| BROKEN CELLS | NOT GOOD | GOOD | GOOD | GOOD |

According to TABLE 1, when the fixing roller 41 has the rubber layer 41*a* having the density of greater than or equal to 0.38 $g/cm^3$, the predetermined width of the fixing nip is maintained even after 60,000 prints were made. Therefore, the fixing roller 41 has higher endurance than that of the related art fixing roller.

Figure 6A:
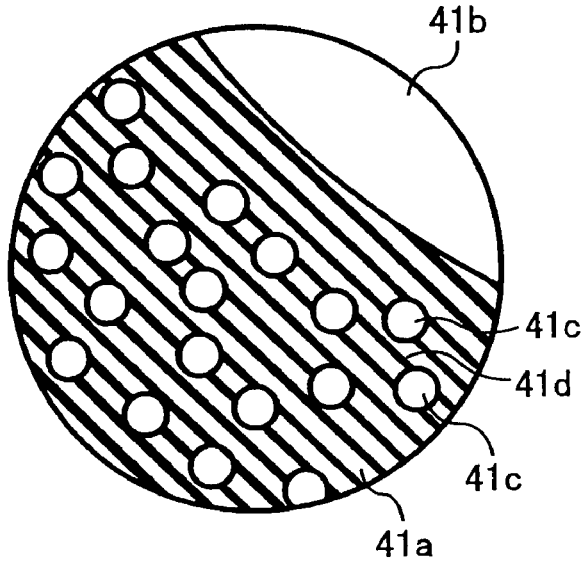
FIGS. 6A and 6B are diagrams illustrating a manner in which a density of a rubber layer of the fixing roller is increased.
Figure 6B:
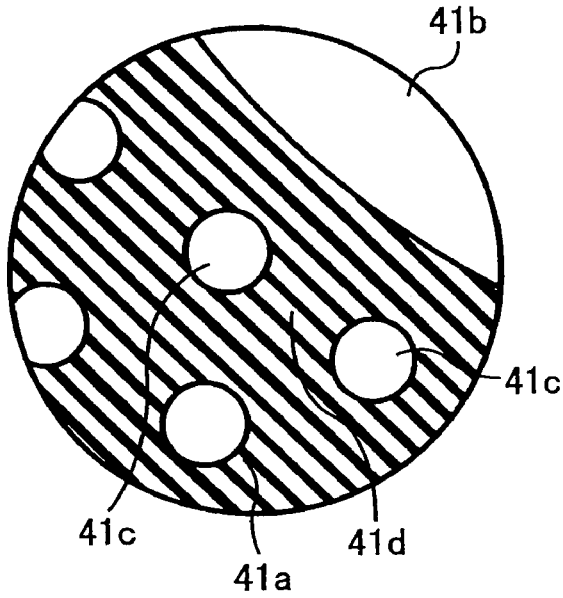

FIGS. 6A and 6B are diagrams illustrating a state in which the rubber density of the rubber layer 41*a* is higher than that of the state shown in FIG. 5B. In a state where the rubber density is high, as shown in FIG. 6A, it may be assumed that the thickness of the wall portions 41*d* does not significantly change, while the number of cells 41*c* with a small diameter is increased. Furthermore, it may be assumed that, as shown in FIG. 6B, the number of the cells 41*c* does not significantly change, and the diameter of the cells 41*c*is reduced. In the state as shown in FIG. 6A, even though the strength of the wall portions 41*d* does not significantly change, the number of the wall portions 41*d* as well as the cells 41*c* is increased so that the stress against each wall portion 41*d* is reduced, and the endurance is enhanced. In the state as shown in FIG. 6B, even though the number of the wall portions 41*d* does not change, the thickness of the wall portions 41*d* is increased so that the strength of each wall portion 41*d* is increased, and the endurance is enhanced.

Accordingly, when the rubber layer 41*a* has the rubber density of greater than or equal to a certain density while having a low stiffness, the endurance of the wall portions 41*d* is enhanced, and the destruction of the cells is prevented. As a result, the endurance of the roller is enhanced.

The above-described center distance is a center distance before use. In other words, it is a center distance when the pressing roller 45 is pressed at 200 N in the pressing direction by the pull spring. When the stiffness of the fixing roller 41 is decreased due to usage over time, the center distance is narrowed. When the center distance is narrowed, the pressing force is decreased less than 200 N. It is assumed that when the center distance is narrowed, the nip width increases. However, in the first experiment, the nip width decreased when using the fixing roller 41 with the decreased stiffness.

The reason may be assumed to be that the amount of increase in the nip due to narrowing of the center distance is greater than the amount of decrease in the fixing nip due to decrease in the elastic force of the surface of the fixing roller 41. Furthermore, in the first experiment, to form the fixing nip, a structure in which the pressing roller 45 was pressed against the fixing roller 41 by the pull spring serving as the pressing mechanism was used. The structure for forming the fixing nip is not limited to the structure using the pressing mechanism. The fixing nip may be formed by disposing the fixing roller 41 and the pressing roller 45 such that the center distance of the two rollers is smaller by the depressed amount than the sum of the radiuses of the fixing roller 41 and the pressing roller 45.

When the fixing nip is formed in the fixing apparatus 4, the fixing roller 41 is pressed into the pressing roller 45 and is deformed. Even if the width of the fixing nip of the fixing roller does not decrease, and the fixability thereof is maintained after 60,000 prints are made, there was a case, in the first experiment, in which the width of the fixing nip decreased after more than 60,000 prints were made, when the fixing roller 41 had the rubber layer 41*a* with a significant deformation ratio.

Figure 7:
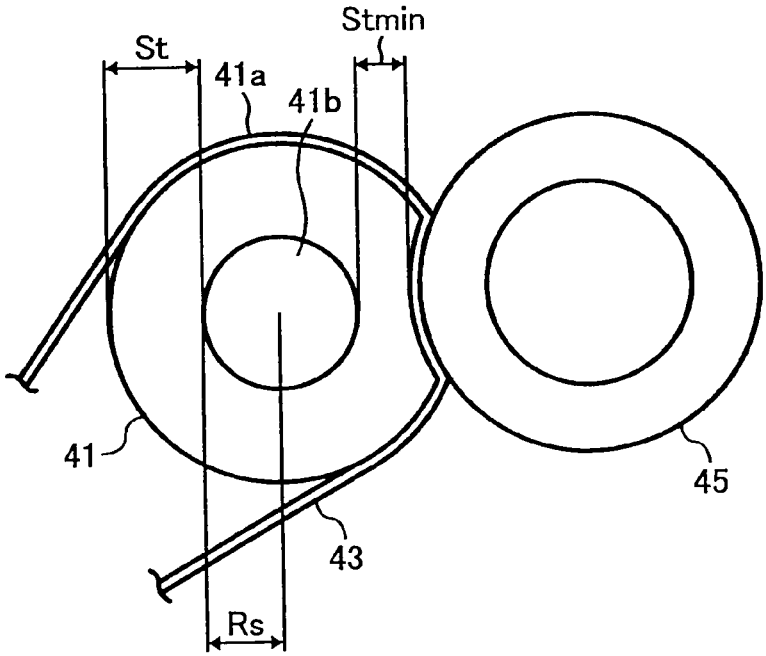
FIG. 7 is a schematic diagram illustrating the fixing roller and a pressing roller forming a fixing nip.

FIG. 7 is a schematic diagram illustrating the fixing roller 41 and the pressing roller 45 which form the fixing nip. In FIG. 7, St denotes a thickness of the rubber layer 41*a*, Stmin denotes the thickness of the rubber layer 41*a* in the fixing nip, and Rs denotes the radius of the metal shaft 41*b*. When the value of Stmin, which is the thickness of the rubber layer 41*a* in a state where the rubber layer 41*a* is pressed down by the pressing roller 45, relatively is large, the deformation amount is small, and the stress to be applied to the rubber is less. Consequently, cells in the rubber are not easily destroyed.

In a second experiment, the fixing apparatus 4 having the structure as shown in FIG. 4 and FIG. 7 was used. An evaluation was performed on the destruction of the cells 41*c* after 80,000 prints were made. Different values of Stmin, which is the thickness of the rubber layer 41*a* in the fixing nip, were used when the stiffness of the pressing roller 45 was greater by at least 20 Hs on the Asker C scale relative to the fixing roller 41. Similarly to the first experiment, the evaluation of the destruction of the cells was performed based on the amount of decrease in the width of the fixing nip. The center distance was adjusted, and the depressed amount for the fixing roller 41 was changed so as to adjust the values of Stmin, which is the thickness of the rubber layer 41*a* in the fixing nip.

The conditions of the second experiment are described as follows. The experimental conditions of the fixing roller are: The diameter is 29 mm; The diameter of the metal shaft made of iron is 10 mm (Rs=5 mm); The thickness St of the rubber layer made of a silicone rubber is 9.5 mm; The stiffness on the Asker C scale is 31 Hs, and the rubber layer density is 0.38 $g/cm^3$. The experimental conditions of the pressing roller are: The diameter is 30 mm; The diameter of the metal shaft made of iron is 23 mm; The thickness of the rubber layer made of a silicone rubber is 3.5 mm; The stiffness on the Asker C scale is 57 Hs; The linear velocity of the surface of the pressing roller is 182 mm/sec; and the center distance is 26.2 mm (Stmin=6.2 mm), 27.1 mm (Stmin=7.1 mm), and 27.8 mm (Stmin=7.8 mm).

TABLE 2 shows the result of the second experiment.

TABLE 2

| | | | |
|---|---|---|---|
| Stmin (mm) | 6.2 | 7.1 | 7.8 |
| St (mm) | 9.5 | 9.5 | 9.5 |
| Stmin/St | 0.65 | 0.75 | 0.82 |
| NIP WIDTH BEFORE USE (mm) | 9.3 | 8.6 | 8.2 |
| NIP WIDTH AFTER 80,000 PRINTS WERE MADE (mm) | 7.0 | 8.2 | 8.0 |
| BROKEN CELLS | NOT GOOD | GOOD | GOOD |

According to TABLE 2, when the relationship of Stmin/St≧0.75 is satisfied, the excessive deformation of the rubber layer 41*a* was prevented, and the endurance was enhanced. Generally, in the color image forming apparatus, the stiffness of the pressing roller 45 is greater than that of the fixing roller 41 so as to enhance the separation of the transfer paper P after fixing. Consequently, when the fixing roller 41 and the pressing roller 45 form the fixing nip, the deformation amount of the fixing roller 41 is greater than that of the pressing roller 45. When the deformation amount (St-Stmin) in the fixing nip relative to the thickness St of the rubber layer 41*a* which is the sponge-like layer is configured to be less than or equal to a certain value, the stress to be applied to the rubber layer 41*a* is reduced, and the endurance of the fixing roller 41 is enhanced.

In order to satisfy such conditions in the fixing apparatus 4, the pressing roller 45 having the stiffness of 57 Hs on the Asker C scale may be used. The fixing roller 41 having the stiffness of 31 Hs on the Asker C scale, the metal shaft 41*b* with the diameter ϕ of 10 mm (Rs=5 [mm]), the rubber layer 41*a* with the thickness of St=9.5 mm, and the rubber layer with the thickness of 7.2 mm when forming the nip may be applied. In such a fixing apparatus 4, Stmin/St(=7.2/9.5≈0.758)≧0.75 is satisfied.

The destruction of the cells was explained with reference to FIGS. 5A, 5B and 5C. The destruction of the cells may easily occur at a place adjacent to the metal shaft. This may be because the fixing roller 41 has a circular cross section and has a rotary body. The center of the rotation is configured to be in the center of the circle. Consequently, during rotation (especially at the time of the start of driving and at the time when driving is stopped), the shearing stress is greater toward the center of the fixing roller 41. The stress to be applied to the wall portions 41*d* that form the cells 41*c* increases causing the cells to be easily broken. The shearing stress to be applied to the rubber layer 41*a* becomes the greatest at the boundary between the metal shaft 41*b*, and the rubber layer 41*a*. Furthermore, because the metal shaft 41*b* is made of metal, there is a significant difference in the strength between the rubber layer 41*a* and the metal shaft 41*b*. Thus, the cells are easily broken in the vicinity of the boundary between the rubber layer 41*a* and the metal shaft 41*b*.

Figure 8:
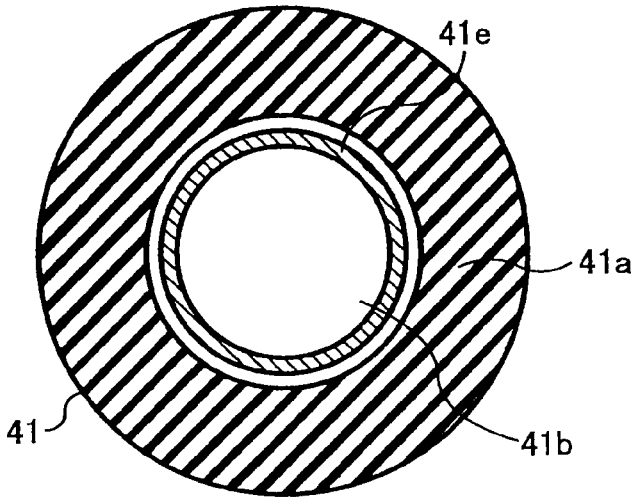
FIG. 8 is a cross-sectional view illustrating the fixing roller from which the rubber layer is separated.

As shown in FIG. 5C, the wall portions 41*d* forming the cells 41*c* on the immediate outside of a boundary layer 41*e* between the rubber layer 41*a* and the metal shaft 41*b* are easily broken. When the destruction of the cells in the vicinity of the boundary layer 41*e* spreads in a circumferential direction and a rotary shaft direction, the rubber layer 41*a* may be separated from the metal shaft 41*b*, leaving the boundary layer 41*e* of a thin layer on the circumferential surface of the metal shaft 41*b* as shown in FIG. 8. When the rubber layer 41*a* is separated, the fixing roller 41 does not function as a roller.

In addition to the complete separation of the rubber layer 41*a* from the metal shaft 41*b* as shown in FIG. 8, the partial separation of the rubber layer 41*a* may cause uneven stiffness of the fixing roller 41, for example. The rotary body has a stress distribution in which the stress is less as the rotary body moves away from the center. Therefore, if the diameter of the metal shaft 41*b* is increased, places where the stress is less may be configured as the boundary between the rubber layer 41*a* and the metal shaft 41*b*. Accordingly, the stress to be applied to the vicinity of the metal shaft 41*b* may be reduced. In other words, in the relationship between the radius Rs of the metal shaft 41*b* and the thickness St of the rubber layer 41*a*, it is necessary to configure the value of St/Rs to be less than a predetermined value.

On the other hand, when the thickness St of the rubber layer 41*a* is too thin, the deformation amount (St-Stmin) ratio relative to the thickness St of the rubber layer 41*a* becomes greater. Similar to the second experiment, the destruction of the cells may easily occur in the entire rubber layer 41*a* so that the stiffness may easily decrease.

In a third experiment, the fixing apparatus 4 having the structure as shown in FIG. 4 and FIG. 7 was used. An evaluation was performed on the separation of the rubber layer 41*a* and the destruction of the cells 41*c* after 100,000 prints were made. Different ratios of the thickness St of the rubber layer 41*a* of the fixing roller 41 to the radius Rs of the metal shaft 41*b* were used.

The conditions of the third experiment are described as follows. The experimental conditions of the fixing roller are: The diameter is 29 mm; The stiffness on the Asker C scale is 31 Hs; and the rubber layer density is 0.38 g/cm$^3$. When the radius of the metal shaft (made of iron) is Rs (mm), and the thickness of the rubber layer (made of silicone rubber) is St (mm), the ratios of St/Rs are: 1.9, 1.5, 1.2 and 1.1. The experimental conditions of the pressing roller are: The diameter is 30 mm; The diameter of the metal shaft made of iron is 23 mm; The thickness of the rubber layer made of a silicone rubber is 3.5 mm; The stiffness on the Asker C scale is 57 Hs; and The linear velocity of the surface of the pressing roller is 182 mm/sec.

TABLE 3 shows experimental conditions for each roller having different ratios of St/Rs.

TABLE 3

| | | | | |
|---|---|---|---|---|
| St/Rs | 1.9 | 1.5 | 1.2 | 1.1 |
| FIXING ROLLER ϕ (mm) | 29 | 29 | 29 | 29 |
| METAL SHAFT ϕ (mm) | 10 | 11.5 | 13 | 14 |
| St (mm) | 9.5 | 8.75 | 8 | 7.5 |
| Rs (mm) | 5 | 5.75 | 6.5 | 7 |
| DEPRESSION AMOUNT (mm) | 2.3 | 2.15 | 2 | 1.85 |
| CENTER DISTANCE OF TWO ROLLERS (mm) | 27.2 | 27.35 | 27.5 | 27.65 |
| Stmin (mm) | 7.2 | 6.6 | 6 | 5.65 |
| Stmin/St | 0.758 | 0.754 | 0.750 | 0.753 |

The result of the third experiment is shown in TABLE 4. The maximum stress (MPa) in the vicinity of the metal shaft is a value of stress in the vicinity of the metal shaft at the time of the start of driving when the above experimental conditions were input in software and a simulation was performed. When the separation of the rubber layer 41*a* in the vicinity of the metal shaft 41*b* occurred, YES is indicated in TABLE 4, whereas, NO is indicated when the separation did not occur. When the destruction of the cells 41*c* occurred, YES is indicated in TABLE 4, whereas, NO is indicated when the destruction of the cells 41*c* did not occur.

TABLE 4

| | | | | |
|---|---|---|---|---|
| St/Rs | 1.9 | 1.5 | 1.2 | 1.1 |
| MAXIMUM STRESS IN THE VICINITY OF METAL SHAFT (MPa) | 11.9 | 8.8 | 7.2 | 5.6 |
| SEPARATION OF RUBBER LAYER NEAR METAL SHAFT | YES | NO | NO | NO |
| NIP WIDTH BEFORE USE (mm) | 8.5 | 8.5 | 8.5 | 8.5 |
| NIP WIDTH AFTER 100,000 PRINTS WERE MADE | 7.0 | 8.4 | 8.5 | 8.5 |
| DESTRUCTION OF CELLS | YES | NO | NO | YES |
| NEITHER SEPARATION OF RUBBER LAYER NEAR METAL SHAFT NOR DESTRUCTION OF CELLS OCCURED | YES | NO | NO | YES |

According to TABLE 4, when the relationship between the radius Rs of the metal shaft 41*b* and the thickness St of the rubber layer 41*a* satisfied St/Rs≦1.5, the separation of the rubber layer 41*a* in the vicinity of the metal shaft 41*b* was suppressed. If the value of St/Rs is too small, that is, the thickness St of the rubber layer 41*a* is too small, the ratio of the deformation amount (St-Stmin) relative to the thickness St of the rubber layer 41*a* becomes greater. Consequently, the cells in the entire rubber layer 41*a* may be easily broken so that the stiffness is decreased. According to TABLE 4, when the relationship between the radius Rs of the metal shaft 41*b* and the thickness St of the rubber layer 41*a* satisfied 1.2≦St/Rs, the excessive deformation of the rubber layer 41*a* was prevented, and the endurance was enhanced.

According to the third experiment, when the fixing roller 41, in which the relationship between the radius Rs of the metal shaft 41*b* and the thickness St of the rubber layer 41*a* is represented as 1.2≦St/Rs≦1.5, is used, the fixing apparatus 4 that prevents the destruction of the cells 41*c* and the separation of the rubber layer 41*a* even after 100,000 prints are made may be attained.

In the vicinity of the boundary between the rubber layer 41*a* and the metal shaft 41*b* of the fixing roller 41, the rubber layer 41*a* is elastically deformed; whereas, the metal shaft 41*b* is comprise of a rigid shaft such as a metal shaft so that the shearing force is easily concentrated at both the time of the start of rotation and at the time the rotation is stopped. The shearing stress applied to the fixing roller 41 is greater toward the center of the rotation. Thus, the shearing stress applied to the rubber layer 41*a* is at maximum in the boundary between the rubber layer 41*a* and the metal shaft 41*b*. Consequently, the area of the rubber layer 41*a* in the vicinity of the metal shaft 41*b* may be easily damaged. When St/Rs, which is the ratio of the radius Rs of the metal shaft 41*b* and the thickness St of the rubber or the sponge-like rubber layer 41*a*, is configured to be less than or equal to a certain amount, the place at a certain distance from the rotation center and with the small shearing force may be configured as the boundary between the rubber layer 41*a* and the metal shaft 41*b*. Furthermore, the area of the boundary between the rubber layer 41*a* and the metal shaft 41*b* is greater at a greater distance from the rotation center. Accordingly, the shearing force applied to the boundary is dispersed, and the shearing stress is reduced. Thereby, the endurance of the roller is enhanced.

When the thickness of the rubber layer 41*a* is thinner compared with the radius of the metal shaft 41*b* so that the stress in the vicinity of the boundary is reduced, the destruction of the cells in the vicinity of the boundary between the rubber layer 41*a* and the metal shaft 41*b* may be reduced. On the other hand, when the sponge-like rubber layer 41*a* is too thin, the deformation amount (St-Stmin) in the fixing nip becomes greater relative to the thickness St of the rubber layer 41*a*. Consequently, the cells are easily destructed. In other words, when the thickness St of the rubber layer is configured to be greater than or equal to a certain thickness, the deformation ratio (the deformation amount per volume) of the rubber layer 41*a* is low. Thus, the endurance of the roller is enhanced. In order to satisfy the above-described conditions, the fixing roller 41 may have, for example, the external diameter ϕ of 29 mm, the metal shaft with the diameter of 100 12 mm (Rs=6 [mm]), the sponge-like rubber layer with the thickness St=8.5 mm. Such a fixing roller 41 may satisfy 1.2<St/Rs(8.5/6≈1.42)≦1.5.

Figure 9:
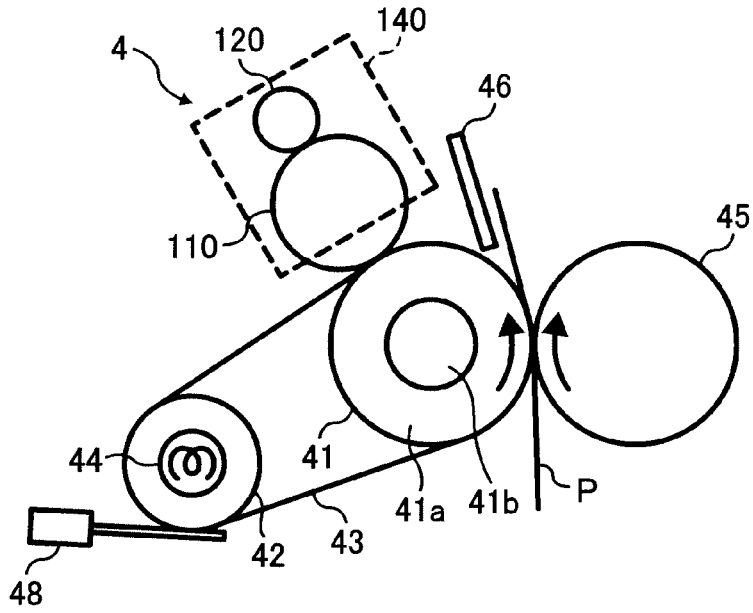
FIG. 9 is a schematic diagram illustrating the fixing apparatus without a tension application member.

In one exemplary embodiment, the description was given of a structure in which the fixing roller 41 is provided as a spanning member of the fixing belt 43, and the pressing roller 45 presses so as to form the fixing nip. As the fixing apparatus, the structure is not limited to the exemplary aspects described in the above described exemplary embodiment. The fixing apparatus including a fixing body and the pressing body, one of which is formed of a belt, may be applied. The fixing body comes into contact with a surface which carries unfixed toner of the recording medium. The pressing body holds the recording medium between the fixing apparatus and the pressing body. As shown in FIG. 9, it may be possible that the fixing belt 43 is not provided with a tension application member for applying tension from outside.

Figure 10:
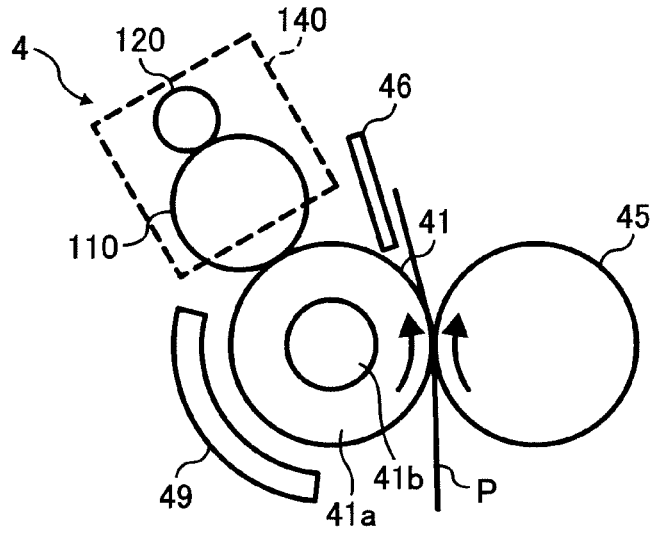
FIG. 10 is a schematic diagram illustrating one example of the fixing apparatus without a fixing belt.

The structure in which two rollers face each other, constituting the fixing nip, may be applied even if the fixing apparatus does not include the fixing belt. One example of the fixing apparatus without the fixing belt is shown in FIG. 10. In the fixing apparatus 4 of FIG. 10, the surface of the fixing roller 41 with low stiffness is formed of a metal layer or a belt having a metal layer. An induction heating (IH) coil 49 is provided facing the metal layer of the fixing roller 41. In the fixing apparatus 4, the metal layer is heated by induction heating from the IH coil 49. Heat and pressure are applied to the toner image on the transfer paper P in the fixing nip.

In one exemplary embodiment, the description was given of the rubber layer 41*a* which is the elastic layer of the fixing roller 41 and of an elastic roller that has a substantially equal density. A description will now be given of another exemplary embodiment in which a structure of the fixing roller 41, serving as another elastic roller, suppresses the destruction of the cells. Constituent elements, except for the fixing roller 41, are similar to that of the above described exemplary embodiment. Thus, the description thereof will be omitted. The description will be given only of the fixing roller 41.

Figure 11A:
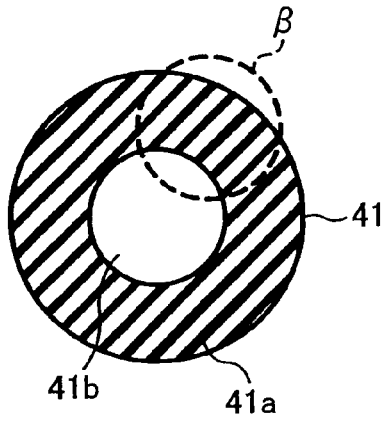
FIG. 11A is a cross-sectional view illustrating a fixing roller according to a second exemplary embodiment.
Figure 11B:
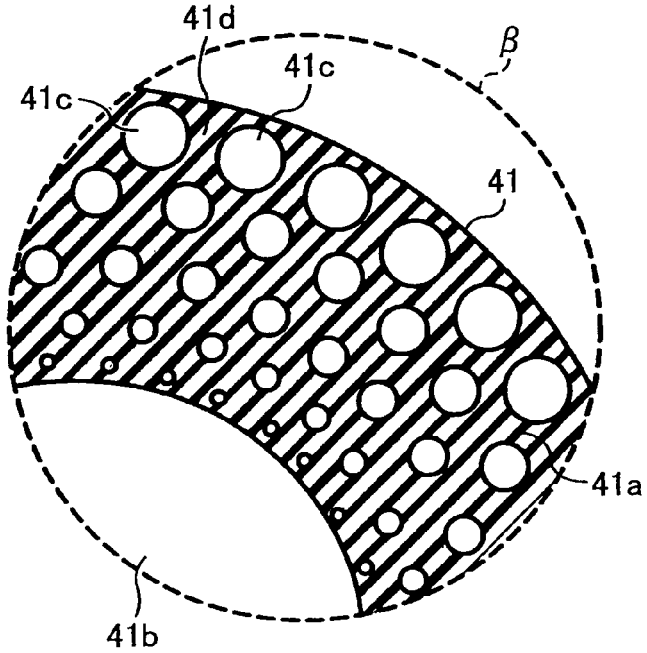
FIG. 11B is an enlarged view illustrating a region β of FIG. 11A.

FIGS. 11A and 11B are schematic diagrams illustrating the fixing roller 41 which is an elastic roller according to another exemplary embodiment. FIG. 11A is a cross-sectional view of the fixing roller 41. FIG. 11B is an enlarged view of a region β of FIG. 11A. As shown in FIG. 11A, similarly to the fixing roller 41 of one exemplary embodiment described above, the fixing roller 41 of another exemplary embodiment is formed of the rubber layer 41*a* which is an elastic layer made of rubber, and the metal shaft 41*b* made of metal. As shown in FIG. 11B, the rubber layer 41*a* of the fixing roller 41 in another exemplary embodiment has a unitary structure in which the cells 41*c* which are holes are formed such that the size of each cell 41*c* becomes smaller towards an inner side, that is, the metal shaft 41*b* side, and becomes greater towards the outside. In other words, the fixing roller 41 having the rubber layer 41*a* with different densities in the radius direction of the roller is used. The densities of the rubber layer 41*a* are higher towards the metal shaft 41*b*.

In such a rubber layer 41*a*, when the cells 41*c* are configured to be smaller towards the metal shaft 41*b*, the wall portions 41*d* become thicker towards the metal shaft 41*b*. Accordingly, the strength of the rubber layer 41*a* becomes greater towards the metal shaft 41*b*. When the number of the cells 41*c* is the same, and the walls are thicker, the density will be greater. In order to create such a rubber layer 41*a*, a foaming agent is mixed in the silicon rubber which is a material for the rubber layer, and then is heated so as to create foams. When heating to create foams, the temperature of the inside is slowly increased while the temperature of the outside is rapidly increased.

The effect of suppressing the destruction of the cells in the sponge-like elastic roller is achieved by increasing the rubber density of the elastic layer. However, if the rubber density is too high, the stiffness on the Asker C scale is increased. As a result, the predetermined nip may not be achieved. Furthermore, if the rubber density is high, the volume occupied by the cells is less, and thus the thermal conductivity becomes high when compared with the elastic layer in which the volume occupied by the cells is greater. Consequently, the amount of heat transferred from the fixing belt 43 increases. As a result, a problem such as slowing down the warm-up may be generated.

As described above, the shearing stress which causes the deformation of the cells in the rubber layer 41*a* of the fixing roller 41 is greater toward the vicinity of the metal shaft 41*b*, that is, the area where the rubber is often damaged. Therefore, when using the fixing roller 41 having the rubber layer 41*a* with the higher density towards the metal shaft 41*b*, the strength in the vicinity of the metal shaft 41*b* may be enhanced, and the stiffness of the surface may be increased. This structure allows the fixing roller 41 to have high endurance while having the characteristics of the sponge-like roller including the low stiffness and the low thermal conductivity. In the related art, there is a roller with two elastic layers, with one layer near the metal shaft formed of a solid rubber, and the other layer or the surface layer formed of a sponge rubber. In such a roller, similar concentration of the stress is generated in the boundary between the solid rubber and the sponge rubber, and the destruction of the cells also occurs. Therefore, similarly to the rubber layer 41*a* of the fixing roller 41 in one exemplary embodiment, the roller of a unitary structure in which the size of the cells 41*c* continuously changes has a longer product life.

As described above, according to one exemplary embodiment, in the fixing apparatus 4 including the fixing roller 41 which is an elastic roller with a low stiffness in the range between 28 Hs and 34 Hs on the Asker C scale, when the density of the rubber layer 41*a* of the fixing roller 41 is configured to be greater than or equal to 0.38 g/cm$^3$, the reduction of the nip width may be suppressed even after an extended period of use, that is, even after 60,000 prints are made, for example. In other words, the destruction of the cells 41 is suppressed even after 60,000 prints were made. The reduction of the fixing nip width after an extended period of use may be suppressed, thereby making it possible to maintain fixability for a long period of time. When the silicone rubber is used for a material for the elastic layer, the sponge-like elastic layer is easily created.

Furthermore, as a plurality of spanning members, the fixing belt 43 supported by the heating roller 42 and the fixing roller 41 is provided. The pressing roller 45 which is a roller with high stiffness presses the fixing roller 41 through the fixing belt 43 so as to form the fixing nip between the fixing roller 41 and the pressing roller 45. Thereby, the fixing belt 43 with high repeatability, instead of the sponge-like fixing roller 41, comes into contact with the toner image on the transfer paper P, and the separation is enhanced. When the stiffness At of the fixing roller 41 on the Asker C scale and the stiffness Ak of the pressing roller 45 on the Asker C scale are configured such that the relationship of Ak>At+20 [Hs] is satisfied, the fixing roller 41 may have a largely depressed shape at the fixing nip. Accordingly, the conveyance direction of the transfer paper P after passing the fixing nip may be on the pressing roller 45 side, that is, a non-imaging side. As a result, separation of the transfer paper P relative to the fixing belt 43 may be enhanced.

When the thickness St of the rubber layer 41*a* and the minimum thickness Stmin of the rubber layer 41*a* in the fixing nip satisfy the relationship of Stmin/St≧0.75, the reduction of the fixing nip width may be suppressed, even after an extended period of use, that is, even after 80,000 prints are made, for example. In other words, the destruction of the cells 41*c* may be suppressed even after 80,000 prints are made. Because the reduction of the fixing nip width may be suppressed even after an extended period of use, fixability may be maintained for a long period of time.

When the radius Rs of the metal shaft 41*b* and the thickness St of the rubber layer 41*a* satisfy the relationship of 1.2≦St/Rs≦1.5, the reduction of the fixing nip width may be suppressed while suppressing the separation of the rubber layer 41*a* from the metal shaft 41*b* even after 100,000 prints are made, for example, or even after an extended period of use. In other words, the destruction of the cells 41*c* may be suppressed even after 100,000 prints are made. Because the reduction of the fixing nip width after an extended period of use may be suppressed, fixability may be maintained for a long period of time.

When using the fixing apparatus 4 as a fixing mechanism of an image forming apparatus such as the printer 100, stable fixability may be maintained for a long period of time, thereby making it possible to maintain the image quality. According to the fixing apparatus 4 of one exemplary embodiment, when the density of the rubber layer 41*a* which is the elastic layer differs in the radius direction of the fixing roller 41, and the density of the rubber layer 41*a* is greater towards the vicinity of the metal shaft 41*b*, the elasticity of the surface of the fixing roller 41 may be maintained. Furthermore, when the rubber layer 41*a* has a unitary structure, and the cells 41*c* are configured to be smaller towards the inner side, that is, the metal shaft 41*b* side, and larger toward outside, the rubber layer 41*a* may have higher endurance towards the metal shaft 41*b*.

Embodiments of this invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor) Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus, comprising:

a toner image forming mechanism configured to form a toner image on a recording medium; and a fixing mechanism configured to fix the toner image on the recording medium, the fixing mechanism including a fixing apparatus, the fixing apparatus including an elastic roller having a stiffness greater than or equal to 28 Hs and less than or equal to 34 Hs on an Asker C scale, and including a sponge-like elastic layer having a density greater than or equal to 0.38 g/cm$^3$;

a high-stiffness roller having a stiffness greater than the stiffness of the elastic roller, the high-stiffness roller configured to form a fixing nip between the elastic roller and the high-stiffness roller; and a heating mechanism configured to heat the fixing nip, wherein the fixing apparatus satisfies a relationship expressed by $Stmin/St \geqq 0.75$, where St is a thickness of the elastic layer in a state where the fixing nip is not formed, and Stmin is a minimum thickness of the elastic layer in a state where the fixing nip is formed.

2. The image forming apparatus according to claim 1, wherein the elastic layer of the elastic roller includes rubber.

3. The image forming apparatus according to claim 1, wherein the fixing apparatus further comprises:

a plurality of spanning members, with one of the spanning members being the elastic roller; and a fixing belt having a belt shape supported by the plurality of spanning members and heated by the heating mechanism, wherein the high-stiffness roller is configured to press the elastic roller via the fixing belt so as to form the fixing nip therebetween.

4. The image forming apparatus according to claim 1, wherein the elastic roller serves as a fixing roller facing, in the fixing nip, a surface carrying an unfixed image on the recording medium; and the high-stiffness roller serves as a pressing roller configured to press, in the fixing nip, a rear surface of the surface carrying the unfixed image on the recording medium.

5. The image forming apparatus according to claim 1, wherein the fixing apparatus satisfies a relationship expressed by $Ak > At + 20$ Hs, where At is the stiffness of the elastic roller on the Asker C scale, and Ak is the stiffness of the high-stiffness roller on the Asker C scale.

6. The image forming apparatus according to claim 1, wherein the elastic roller includes the elastic layer and a metal shaft comprising metal.

7. The image forming apparatus according to claim 6, wherein the fixing apparatus satisfies a relationship expressed by $St/Rs \leqq 1.5$, where Rs is a radius of the metal shaft, and St is the thickness of the elastic layer.

8. The image forming apparatus according to claim 7, wherein the fixing apparatus satisfies a relationship expressed by $1.2 \leqq St/Rs \leqq 1.5$, where Rs is the radius of the metal shaft, and St is the thickness of the elastic layer.

9. The image forming apparatus according to claim 1, wherein the density of the elastic layer differs in a radial direction of the elastic roller; and the density of the elastic layer is greater toward a metal shaft.

10. An image forming apparatus, comprising:

a toner image forming mechanism configured to form a toner image on a recording medium; and a fixing mechanism configured to fix the toner image on the recording medium, the fixing mechanism including a fixing apparatus, the fixing apparatus including an elastic roller including a sponge-like elastic layer and a metal shaft comprising metal;

a high-stiffness roller with a stiffness greater than a stiffness of the elastic roller and configured to form a fixing nip between the elastic roller and the high-stiffness roller; and a heating mechanism configured to heat the fixing nip, wherein the stiffness of the elastic roller is greater than or equal to 28 Hs and less than or equal to 34 Hs on an Asker C scale;

a density of the elastic layer differs in a radial direction of the elastic roller; and the density of the elastic layer is greater toward the metal shaft.

11. The image forming apparatus according to claim 10, wherein the elastic layer has a unitary structure, including cells that are smaller in size towards an inner side of the elastic layer, and greater in size towards an outside of the elastic layer.

12. The image forming apparatus according to claim 10, wherein the elastic layer includes rubber.

13. The image forming apparatus according to claim 10, wherein the fixing apparatus further comprises:

a plurality of spanning members, with one of the spanning members being the elastic roller; and a fixing belt having a belt shape supported by the plurality of spanning members and heated by the heating mechanism, wherein the high-stiffness roller is configured to press the elastic roller via the fixing belt so as to form the fixing nip therebetween.

14. The image forming apparatus according to claim 10, wherein the elastic roller of the fixing apparatus is a fixing roller facing, in the fixing nip, a surface carrying an unfixed image on the recording medium; and the high-stiffness roller is a pressing roller configured to press, in the fixing nip, a rear side of the surface carrying the unfixed image on the recording medium.

15. The image forming apparatus according to claim 10, wherein the fixing apparatus satisfies a relationship expressed by $Ak>At+20$ Hs, where At is the stiffness of the elastic roller on the Asker C scale, and Ak is the stiffness of the high-stiffness roller on the Asker C scale.

16. A fixing mechanism configured to fix the toner image on the recording medium and including a fixing apparatus, the fixing apparatus comprising:

an elastic roller having a stiffness greater than or equal to 28 Hs and less than or equal to 34 Hs on an Asker C scale and including a sponge-like elastic layer having a density greater than or equal to 0.38 g/cm$^3$, and including a metal shaft comprising metal, wherein the elastic roller satisfies a relationship expressed by $1.2 \leqq St/Rs \leqq 1.5$, where Rs is a radius of the metal shaft, and St is a thickness of the elastic layer;

a high-stiffness roller having a stiffness greater than the stiffness of the elastic roller and configured to form a fixing nip between the elastic roller and the high-stiffness roller; and a heating mechanism configured to heat the fixing nip.

17. The fixing mechanism according to claim 16, wherein the fixing apparatus further comprises:

a plurality of spanning members, with one of the spanning members being the elastic roller; and a fixing belt having a belt shape supported by the plurality of spanning members and heated by the heating mechanism, wherein the high-stiffness roller is configured to press the elastic roller via the fixing belt so as to form the fixing nip therebetween.

18. The fixing mechanism according to claim 16, wherein the fixing apparatus satisfies a relationship expressed by $Stmin/St \geqq 0.75$, where St is the thickness of the elastic layer in a state where the fixing nip is not formed, and Stmin is a minimum thickness of the elastic layer in a state where the fixing nip is formed.

19. The fixing mechanism according to claim 16, wherein the density of the elastic layer differs in a radial direction of the elastic roller; and the density of the elastic layer is greater toward the metal shaft.

* * * * *